US011845583B2

(12) United States Patent
West

(10) Patent No.: US 11,845,583 B2
(45) Date of Patent: Dec. 19, 2023

(54) OXYGEN RESISTANT CANISTER

(71) Applicant: Ellery West, Crescent City, CA (US)

(72) Inventor: Ellery West, Crescent City, CA (US)

( * ) Notice: Subject to any disclaimer, the term of this patent is extended or adjusted under 35 U.S.C. 154(b) by 197 days.

(21) Appl. No.: 17/342,399

(22) Filed: Jun. 8, 2021

(65) Prior Publication Data

US 2021/0380308 A1 Dec. 9, 2021

Related U.S. Application Data

(60) Provisional application No. 63/036,780, filed on Jun. 9, 2020.

(51) Int. Cl.
*B65D 8/00* (2006.01)
*B65D 23/08* (2006.01)

(52) U.S. Cl.
CPC ..... *B65D 15/06* (2013.01); *B65D 23/0807* (2013.01); *B65D 23/0842* (2013.01)

(58) Field of Classification Search
CPC . B65D 15/06; B65D 23/0807; B65D 23/0842
See application file for complete search history.

(56) References Cited

U.S. PATENT DOCUMENTS

| | | | | |
|---|---|---|---|---|
| 4,950,512 | A * | 8/1990 | Akao | B32B 27/08 428/476.3 |
| 4,982,872 | A | 1/1991 | Avery | |
| 2022/0073231 | A1 * | 3/2022 | Lim | B65D 3/06 |

FOREIGN PATENT DOCUMENTS

| | | | | |
|---|---|---|---|---|
| JP | 200553173 | | | 3/2005 |
| JP | 2005053173 | A | * | 3/2005 |
| JP | 3148189 | U | * | 2/2009 |
| JP | 3148189 | U | | 2/2009 |
| JP | 6051899 | B2 | * | 12/2016 |
| JP | 6051899 | B2 | | 12/2016 |
| KR | 101875521 | B1 | | 8/2018 |
| KR | 1020160049679 | | | 8/2018 |

* cited by examiner

*Primary Examiner* — Anthony D Stashick
*Assistant Examiner* — L Kmet
(74) *Attorney, Agent, or Firm* — Fish IP Law, LLP

(57) ABSTRACT

A paper or other fibrous container is capable of maintaining a consistent gas level after sealing, as well as having sufficient stiffness to carry liquids and other heavy materials as well as light weigh materials such as medication and supplements. Preferred embodiments include a fibrous outer sleeve having an inwardly directed curled edge, a first metal sleeve positioned inward of the fibrous outer sleeve, and a bottom piece having a top metal layer. The bottom piece is preferably disposed intermediate the inwardly directed curled edge and the first metal sleeve. A first adhesive is preferably disposed intermediate the bottom piece and the first metal sleeve, and a second adhesive is preferably disposed intermediate the bottom piece and the inwardly directed curled edge.

13 Claims, 3 Drawing Sheets

OXYGEN RESISTANT CANISTER

FIELD OF THE INVENTION

This application claims the benefit of U.S. Patent Application No. 63/036,780 filed on Jun. 9, 2020. This and all other referenced extrinsic materials are incorporated herein by reference in their entirety. Where a definition or use of a term in a reference that is incorporated by reference is inconsistent or contrary to the definition of that term provided herein, the definition of that term provided herein is deemed to be controlling.

BACKGROUND

The background description includes information that may be useful in understanding the present invention. It is not an admission that any of the information provided herein is prior art or relevant to the presently claimed invention, or that any publication specifically or implicitly referenced is prior art.

Metal containers have been long used to prevent gasses from infiltrating into the contained contents. To reduce cost and environmental impact, it is known to use metal foil side walls, with a layer of paper or other fibrous material to stiffen the walls. And to reduce infiltration of gasses still further, it is known to place the fibrous layer between first and second layers of metal foil. Examples can be found in U.S. Pat. No. 4,982,872, and a drawing from that patent is included herein as prior art FIG. 1.

There are, however, manufacturing issues that arise with use of dual layer metal foils. For example, in the container of FIG. 1, manufacturing requires placing contents inside a sealed metal bag 54, adhering the sealed metal bag 54 inside the paper sheath 3 using an adhesive 25, then adhering the outer sheath 59 to a paper support 66 using adhesive, and then sealing the top of the sheath 59 using an induction liner 49.

All of the above is complicated, and makes for expensive production. What is needed is a stiffened metal foil container that is inexpensive and easier to manufacture.

SUMMARY OF THE INVENTION

The inventive subject matter provides apparatus, systems and methods in which a container is manufactured from a stiffened foil body, a stiffened foil bottom disk, and minimal applications of adhesive.

In preferred embodiments the body is a cylinder, and the stiffened foil bottom is a disk. In more preferred embodiments the body and bottom each comprise a fibrous layer positioned between two foil layers. The body is also preferably curled at the top of the container, which receives an induction liner. Further stiffening can be provided by an outer paper or other fibrous sleeve, which can be curled at its lower end to support the stiffened foil bottom disk, and is optionally shorter than the body.

In at least some embodiments, adhesives are only needed between the curled body and the induction layer, between the body and the top surface of the stiffened foil bottom disk, and between the bottom surface of the stiffened foil bottom disk and the curled end of the outer fibrous sleeve.

Plastic coatings can be included between a fibrous layer and a foil layer of the body and bottom disk and as appropriate.

Various objects, features, aspects and advantages of the inventive subject matter will become more apparent from the following detailed description of preferred embodiments, along with the accompanying drawing figures in which like numerals represent like components.

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

All publications herein are incorporated by reference to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

In some embodiments, the numbers expressing quantities of ingredients, properties such as concentration, reaction conditions, and so forth, used to describe and claim certain embodiments of the invention are to be understood as being modified in some instances by the term "about." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the invention are approximations, the numerical values set forth in the specific examples are reported as precisely as practicable. The numerical values presented in some embodiments of the invention may contain certain errors necessarily resulting from the standard deviation found in their respective testing measurements.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

The recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

FIGURES

FIG. 1 is a reproduction of a prior art figure from U.S. Pat. No. 4,982,872.

DETAILED DESCRIPTION

The container in the current subject matter is capable of maintaining a consistent gas level after sealing, as well as having sufficient stiffness to carry liquids and other heavy materials as well as light weigh materials such as medication and supplements.

Figure 1:
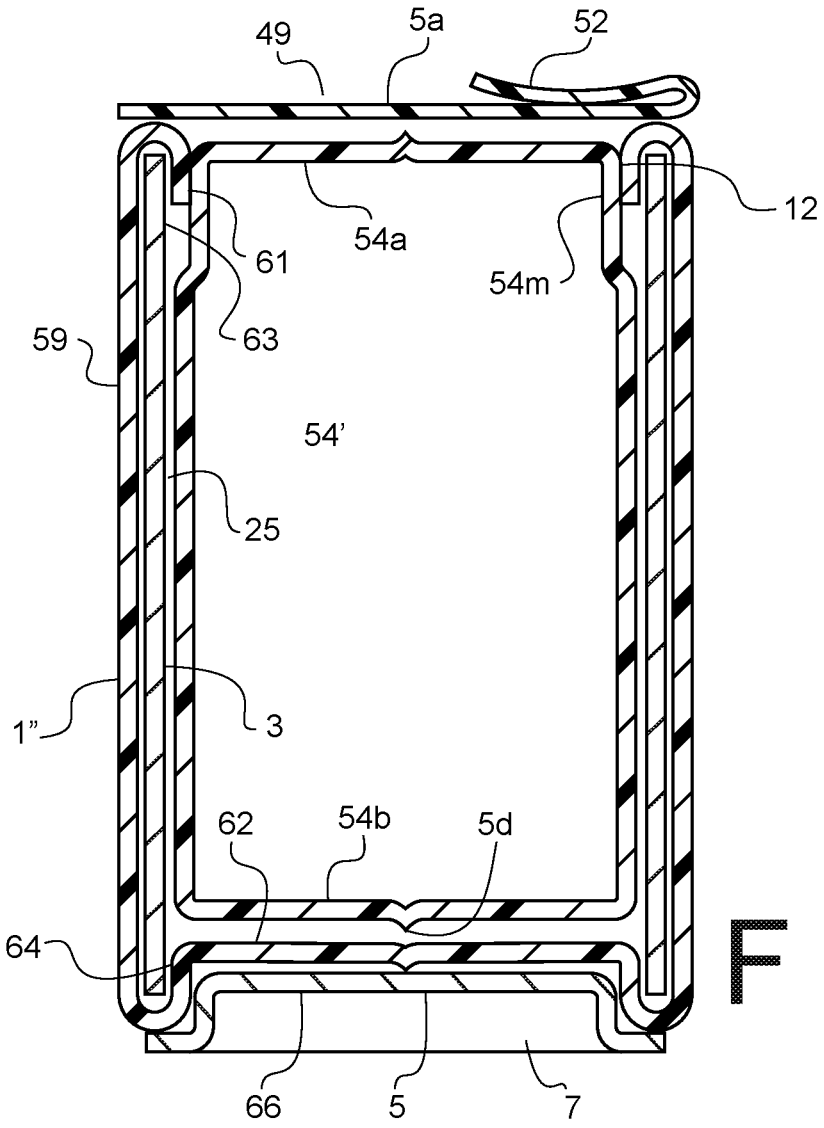
FIG. 1 (Prior Art)
Figure 2:
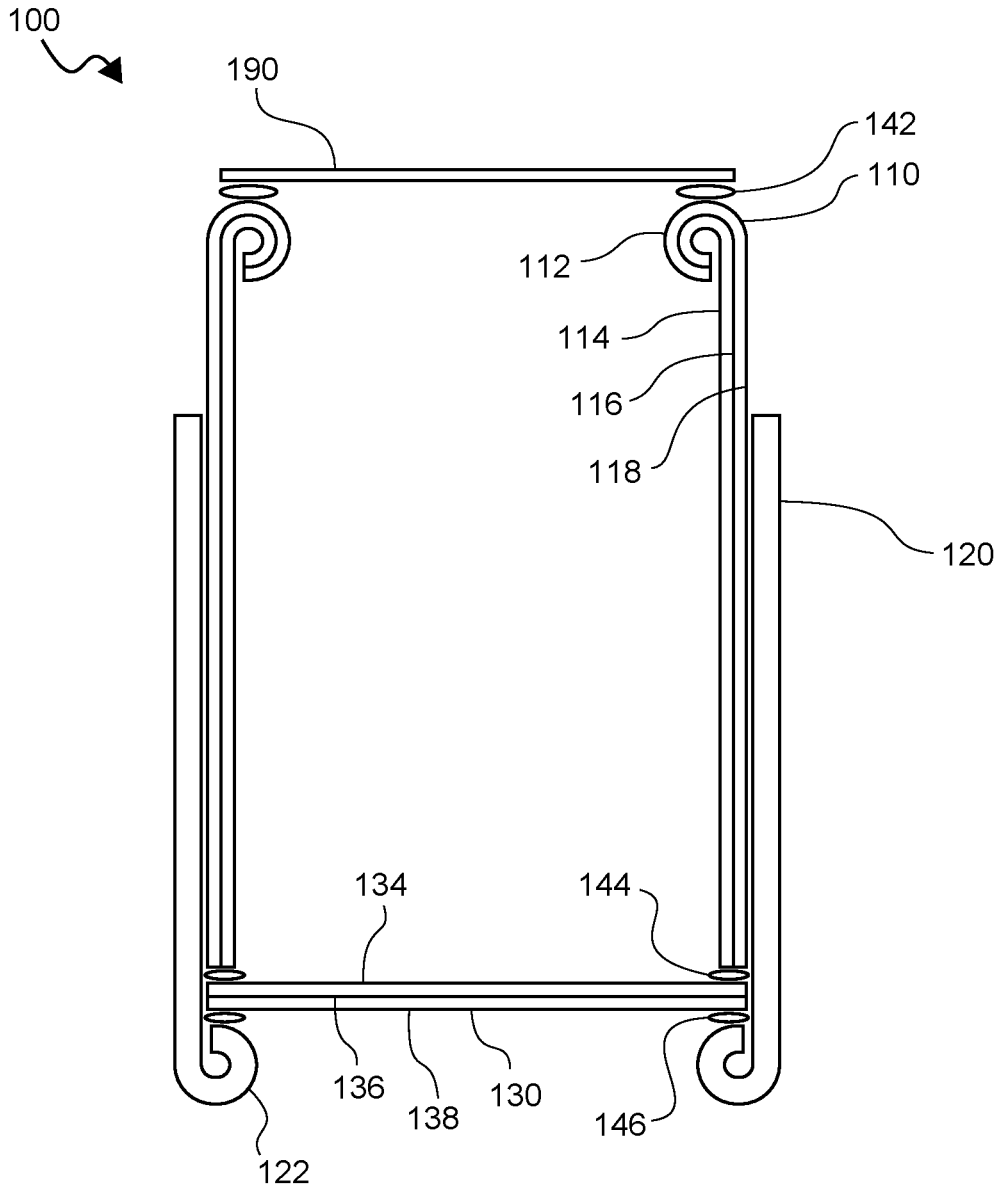
FIG. 2 is a cross-sectional view of a container, sealed at its top opening using an induction liner.

FIG. 2 shows a cross-sectional view of a container 100 sealed at its top opening by an induction liner 190. The side wall 110 of the container 100 includes an intermediate fibrous material layer 116 sandwiched between an inner metal layer 114 and an outer metal layer 118. The bottom disk 130 of the container 100 also has the same structure as the side wall 110, having an intermediate fibrous material layer 136 sandwiched between an inner metal layer 134 and an outer metal layer 138.

Experimentation has shown that even with quite thin metal foil layers, the use of two foil layers provides a consistent gas level inside of the container after sealing. Where the two metal layers 114, 118 are aluminum or steel, the ambient air penetration through the container is inhibited by at least 900% even where the layers are as thin as 9 μm, while the typical metal foil thickness is in the range of 9-12 μm.

Vacuum metallization can be achieved by gas-disposition of aluminum directly to a substrate, such as a paper. This method can achieve similar oxygen resistance with far less metal, on the order of 300 times less. In such cases, contemplated ranges for thickness of the metal layers is in the range of only 0.04-12 μm. These results are apparently achieved by eliminating oxygen ingress through the paper itself, and insuring that minor material or production flaws of either metallized layer is less likely to decrease finished package sigma.

Interestingly, when only a single vacuum metalized layer is used, the oxygen transmission rate is about 875 cc/(package—day), i.e., with little to no improvement relative to a paper bag. A double layer, however, improves oxygen transmission rate down to 8.98 cc/(package—day), about a hundred times better than a single layer.

It should be appreciated that the combination of the metal and the fibrous material layers creates an environmentally friendly and cost-effective container. Fibrous materials such as papers and cardboards are generally preferred since they are biodegradable. Metals that can be recycled are also preferred. Additionally, the metal used in multi-layer paper packaging typically is not recycled, though it could be should economics warrant the effort. The metal of metallized paper used in some contemplated embodiments could be recycled because it is expected to oxidize and become a soil component.

As further shown in FIG. 2, one or more stiffening outer layers 120 of fibrous material can be utilized on the outside of the outer metal layer 118. The stiffening outer layers 120 can have a curled end 122 at its lower end to support the bottom disk 130, and is optionally shorter than the side wall 110.

One advantage of the embodiment of FIG. 2 is that the container 100 requires only three layers of adhesive, an upper layer of adhesive 142 between the induction liner 190 and a curled upper end 112 of the side wall 110, an intermediate layer of adhesive 144 between the side wall 110 and the top surface of the bottom disk 130, and a lower layer of adhesive 146 between the bottom surface of the bottom disk 130 and a curled lower end 122 of the outer fibrous layer 120.

As used herein, an "adhesive" is any compound in a liquid or semi-liquid state used to adhere or bond items together. Prior to hardening, adhesives could be pastes (very thick) or glues (relatively fluid, water-based). All commercially suitable adhesives are contemplated, including for example hot-melt adhesives, library paste or simply glue made from water, milk powder, vinegar, and baking soda. The adhesives are preferably biodegradable. Once the adhesive is cured, the portion applied the adhesive becomes inherently non-adhesive on its external surface, yet retains a strong bond between surfaces and substantially maintains impermeability to air, and preferably also substantially impermeable to oils and water.

As used herein, an "induction liner" is a seal for a container. All commercially suitable induction liners are contemplated, including, for example, FoilSeal™ induction liner, Safe-Gard™ induction liner, Life 'n' Peel™ induction liner, Deltaseal™ induction liner, Top Tab™ induction liner, Uni-Gard™ induction liner, and foil heat induction liner.

In some embodiments, a plastic film (not shown) can be included between the inner metal layer 114/134 and the intermediate fibrous layer 116/136, or between the intermediate fibrous layer 116/136 and the outer metal layer 118/138. As used herein, a "plastic film" is a plastic sheet having thickness of 0.03-0.25 mm. All commercially suitable plastic films are contemplated, including for those that are substantially impermeable to gas (air), oil, and water and UV light. Preferred plastic films are biodegradable and/or recyclable.

In some embodiments, the intermediate fibrous layer 116 of the wall is substantially thinner than the outer fibrous layer 120. The intermediate fibrous layer 116 can be quite thin because it is mostly used to provide a separation between the metal layers 114 and 118. On the other hand, the outer fibrous layer 120 is preferably rather thick so that it can provide mechanical structure to the container 100. This can be quite important for containers that carry heavy materials such as juice or carbonated water. For containers that carry relatively light weight materials such as medications and supplements, the outer fibrous layer 120 can be relatively thin.

In some embodiments, the adhesives 142, 144, 146 are different from the adhesive used to couple the metal layer 114, 118, 134, 138 and the fibrous layer 116, 136. In other embodiments, the adhesives 142, 144, 146 are identical to the adhesive used to couple the metal layer 114, 118, 134, 138 and the fibrous layer 116, 136.

In some embodiments, a stiffening outer fibrous layer similar to outer fibrous layer 120 can be disposed on the bottom of the bottom disk 130. It is contemplated that a stiffening outer fibrous layer below the bottom disk 130 can be used to provide additional structural support for cases where heavy materials are added to the canister. In such embodiments, an adhesive can be disposed between a top surface of the stiffening outer fibrous layer and the bottom surface of the bottom disk 130, and an adhesive can be disposed between a bottom surface of the stiffening outer fibrous layer and the curled end 122. The adhesive between the top surface of the stiffening outer fibrous layer and the bottom surface of the outer layer 138 can be disposed at least partially on the circumferential edge of the bottom disk 130 and the stiffening outer fibrous layer. The adhesive can be identical to the adhesive 144.

Figure 3:
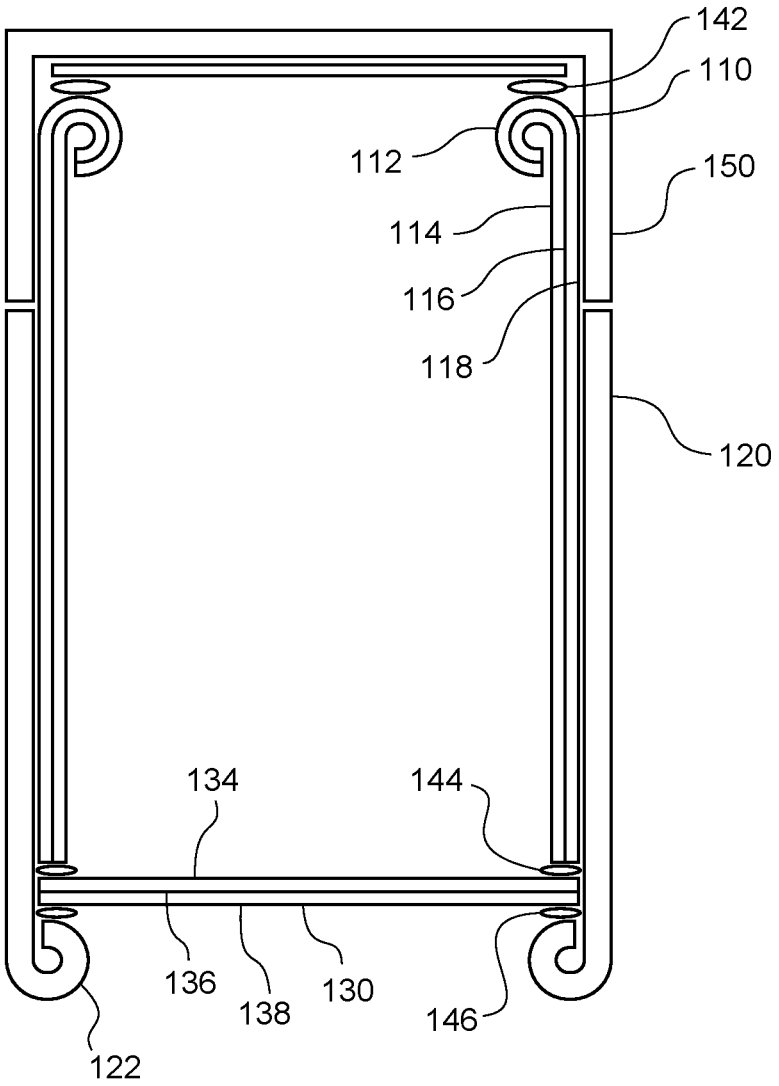
FIG. 3 is a cross-sectional view of a container with a lid.

As shown in FIG. 2, the outer fibrous layer 120 can be shorter than the side wall 110. It is contemplated that the height difference allows a lid 150 to be placed onto the container 100 to cover the induction liner 190 and an upper surface of the side wall 110, as shown in FIG. 3. The lid 150 can be made of the same material, and have the same thickness, as the outer fibrous layer 120. Alternative lids are contemplated that have a metal and/or plastic layer like the side wall 110.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A container, comprising:

a fibrous outer sleeve, having an inwardly directed curled edge at a bottom end a side wall positioned inward of the fibrous outer sleeve, comprising:

a first metal sleeve positioned inward of the fibrous outer sleeve;

a fibrous inner sleeve positioned directly inward of the first metal sleeve; and a second metal sleeve positioned directly inward of the fibrous inner sleeve;

a bottom piece disposed intermediate the inwardly directed curled edge and the first metal sleeve wherein the bottom piece comprises a laminate having a metal layer and a fibrous layer; and a first adhesive disposed intermediate the bottom piece and the first metal sleeve.

2. The container of claim 1, wherein the metal layer of the laminate is a top layer, the fibrous layer is a middle layer, and a second metal layer is a bottom layer.

3. The container of claim 1, further comprising an induction liner, and a third adhesive positioned to sealingly couple the induction liner to the inwardly curled top of the side wall.

4. The container of claim 1, wherein the fibrous outer sleeve is vertically shorter than the first metal sleeve.

5. The container of claim 1, wherein the second metal sleeve is not completely coated with a plastic.

6. The container of claim 1, wherein the first adhesive sealingly couples the bottom piece and the second metal and the fibrous inner sleeves.

7. The container of claim 1, wherein the first adhesive sealingly couples the bottom piece and the first metal sleeve.

8. The container of claim 1, wherein the fibrous outer sleeve is not completely coated with a plastic.

9. The container of claim 1, wherein the first metal sleeve is not completely coated with a plastic.

10. The container of claim 1, further comprising a second adhesive disposed intermediate the bottom piece and the inwardly directed curled edge.

11. The container of claim 1, wherein the side wall has an inward curl at a top end.

12. The container of claim 10, wherein the second adhesive sealingly couples the bottom piece and the inwardly directed curled edge.

13. The container of claim 10, wherein the first and second adhesives are each water soluble.

* * * * *